US009127503B2

(12) United States Patent
Petta

(10) Patent No.: US 9,127,503 B2
(45) Date of Patent: Sep. 8, 2015

(54) SILL ASSEMBLY FOR A DOOR FRAME

(71) Applicant: Alpa Lumber Inc., Mississauga (CA)

(72) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 0 days.

(21) Appl. No.: 14/271,133

(22) Filed: May 6, 2014

(65) Prior Publication Data

US 2014/0338265 A1 Nov. 20, 2014

Related U.S. Application Data

(60) Provisional application No. 61/819,719, filed on May 6, 2013.

(51) Int. Cl.

| | |
|---|---|
| ***E06B 1/70*** | (2006.01) |
| ***E04G 23/02*** | (2006.01) |
| ***E06B 3/70*** | (2006.01) |

(52) U.S. Cl.

CPC ..... *E06B 1/70* (2013.01); *E04G 23/0277* (2013.01); *E06B 3/70* (2013.01)

(58) Field of Classification Search

CPC ..... E06B 1/70; E06B 3/70; E04G 23/0277
USPC ..... 49/467, 468, 469; 52/211, 212
See application file for complete search history.

(56) References Cited

U.S. PATENT DOCUMENTS

| | | | | |
|---|---|---|---|---|
| 3,521,404 | A * | 7/1970 | Hager et al. | 49/468 |
| 4,513,536 | A * | 4/1985 | Giguere | 49/470 |
| 4,831,779 | A * | 5/1989 | Kehrli et al. | 49/471 |
| 4,945,680 | A * | 8/1990 | Giguere | 49/468 |
| 5,943,825 | A | 8/1999 | Procton et al. | |
| 6,052,949 | A | 4/2000 | Procton et al. | |
| 6,216,395 | B1 * | 4/2001 | Kelly | 49/467 |
| 6,269,591 | B1 * | 8/2001 | Kelly | 49/482.1 |
| 6,289,635 | B1 * | 9/2001 | Procton et al. | 49/467 |
| D638,142 | S | 5/2011 | Van Camp et al. | |
| 8,443,554 | B1 * | 5/2013 | Teodorovich | 49/506 |
| 8,567,128 | B2 * | 10/2013 | Van Camp et al. | 49/468 |
| 8,857,107 | B1 * | 10/2014 | Key | 49/460 |
| 2006/0005470 | A1 * | 1/2006 | Mullen et al. | 49/467 |
| 2013/0247471 | A1 * | 9/2013 | Van Camp et al. | 49/469 |
| 2013/0276376 | A1 * | 10/2013 | Gilbert et al. | 49/469 |
| 2014/0318021 | A1 * | 10/2014 | Van Camp et al. | 49/469 |

* cited by examiner

*Primary Examiner* — Jerry Redman

(74) *Attorney, Agent, or Firm* — Bereskin & Parr LLP/S.E.N.C.R.L., s.r.l.

(57) ABSTRACT

An example of a sill assembly for a door frame includes a sub sill extending along a generally horizontal sill axis. The sub sill includes a sub sill upper portion. A base sill extends along the sill axis. The base sill is mounted to the sub sill and clads at least a portion of the sub sill upper portion. The base sill includes at least one base sill clip member. A step sill extends along the sill axis. The step sill includes an axially extending step sill upper surface positioned above the base sill, and at least one step sill clip member removably engaged with the base sill clip member to removably mount the step sill to the base sill.

8 Claims, 7 Drawing Sheets

SILL ASSEMBLY FOR A DOOR FRAME

This application claims the benefit of Provisional Application Ser. No. 61/819,719, filed May 6, 2013, which is hereby incorporated herein by reference.

FIELD

The disclosure relates to sill assemblies for door frames. Specifically, the disclosure relates to modular sill assemblies that may be fabricated from one or more extruded lineals.

BACKGROUND

U.S. Pat. No. 5,943,825 (Procton et al.) and U.S. Pat. No. 6,052,949 (Procton et al.) purport to disclose a building entryway system with a high degree of modularity to accommodate active inswing doors or inactive sidelight panels for use with conventional jambs. Specifically, an extruded aluminum sill is mated with an extruded polymeric receiving unit. The receiving unit defines a u-shaped channel which accepts a weather strip or panel cap. Either the weather strip or panel cap is slidably positioned within the channel under the door. Additionally a door sweep attached to the active doors sealingly engages the weather strip to prevent water from entering the building.

SUMMARY

The following summary is intended to introduce the reader to various aspects of the applicant's teaching, but not to define any invention.

According to one aspect, a sill assembly for a door frame, comprises a sub sill extending along a generally horizontal sill axis. The sub sill comprises a sub sill upper portion. The base sill extends along the sill axis. The base sill is mounted to the sub sill and clads at least a portion of the sub sill upper portion. The base sill comprises at least one base sill clip member. The door frame. The step sill extends along the sill axis. The step sill comprises an axially extending step sill upper surface positioned above the base sill. At least one step sill clip member is removably engaged with the base sill clip member to removably mount the step sill to the base sill.

In some examples, the step sill may include a step sill wall defining the step sill upper surface. The step sill wall may be spaced from the base sill.

In some examples, the step sill wall may define an opposed step sill lower surface, and the at least one step sill clip member may extend downwardly from the step sill lower surface.

In some examples, the at least one step sill clip member may include a first step sill clip member and a second step sill clip member.

In some examples, the at least one base sill clip member may comprise a first base sill clip member removably engaged with the first step sill clip member, and a second base sill clip member removably engaged with the second step sill clip member.

In some examples, the sill assembly may further comprise a door sweep separately formed from the step sill, base sill, and sub sill. The door sweep comprises a first door sweep clip member. The base sill comprises a third base sill clip member, and the first door sweep clip member is removably engaged with the third base sill clip member.

In some examples, the sill assembly may further comprise a nosing. The nosing may be removably mounted to the base sill. The nosing may be an extruded lineal.

According to another aspect, a cover plate for a nosing of a door frame sill assembly, the cover plate extending along a longitudinal axis, comprises a cover plate clip member for removably mounting the cover plate to the nosing. The cover plate comprises a cover plate cladding portion for cladding at least a portion of the nosing. The cover plate cladding portion comprises a cladding portion depth perpendicular to the longitudinal axis and at least one marker. The cover plate cladding portion is severable at the marker to adjust the cladding portion depth to fit the nosing.

In some examples, the cover plate cladding portion may include a generally planar plate having a first end and a second end.

In some examples, the cover plate cladding portion may be severable to remove the second end from the first end.

In some examples, the cover plate clip member may extend from the first end. The cover plate clip member may be generally L-shaped.

In some examples, the cover plate clip member may include a clip member marker. The cover plate clip member may be severable at the clip member marker to adjust the cover plate clip member to fit the nosing. At least one marker may include a plurality of markers.

In some examples, the markers may extend along the cover plate cladding portion transversely to the cladding portion depth. Each marker may comprise a score line along which the cover plate is severable.

In some examples, the cover plate cladding portion may include a lower surface, and the markers are provided on the lower surface.

According to another aspect, a method for repairing a door frame sill assembly copmrises: a) removing a first cover plate from a nosing of the door frame sill assembly; b) adjusting a depth of a cladding portion of a second cover plate to fit the nosing; and c) removably clipping the second cover plate to the nosing such that the cladding portion of the second cover plate clads the nosing.

Other aspects and features of the present specification will become apparent, to those ordinarily skilled in the art, upon review of the following description of specific examples of the teaching disclosed herein.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
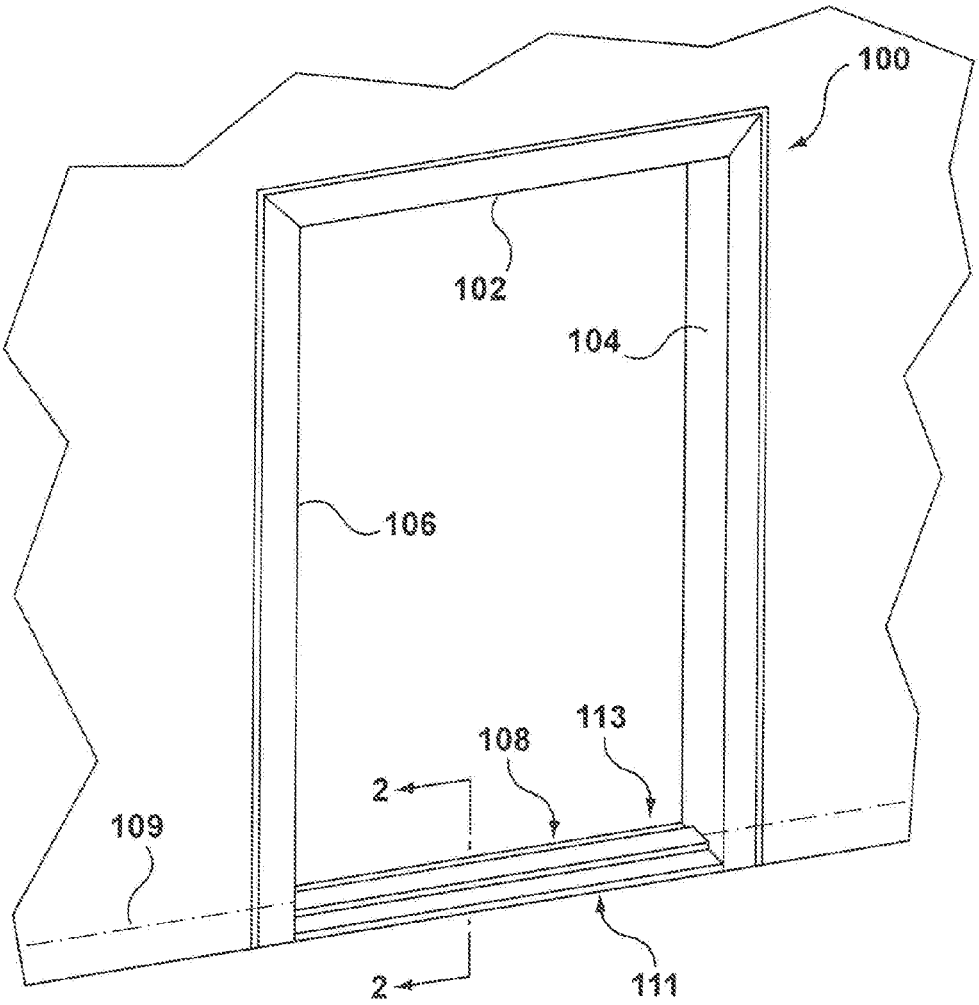
FIG. 1 is a perspective view of an example door frame including an example sill assembly.

Referring to FIG. 1, an example door frame 100 is shown. The door frame 100 may be an exterior door frame, and may be installed in a building such as a home. The door frame 100 includes a header 102, a pair of jambs 104, 106, and a sill assembly 108. The sill assembly 108 extends longitudinally along a generally horizontal sill axis 109, and laterally between an exterior side 111 and an interior side 113. A door 115 (shown in FIG. 2) may be mounted in the door frame.

Figure 2:
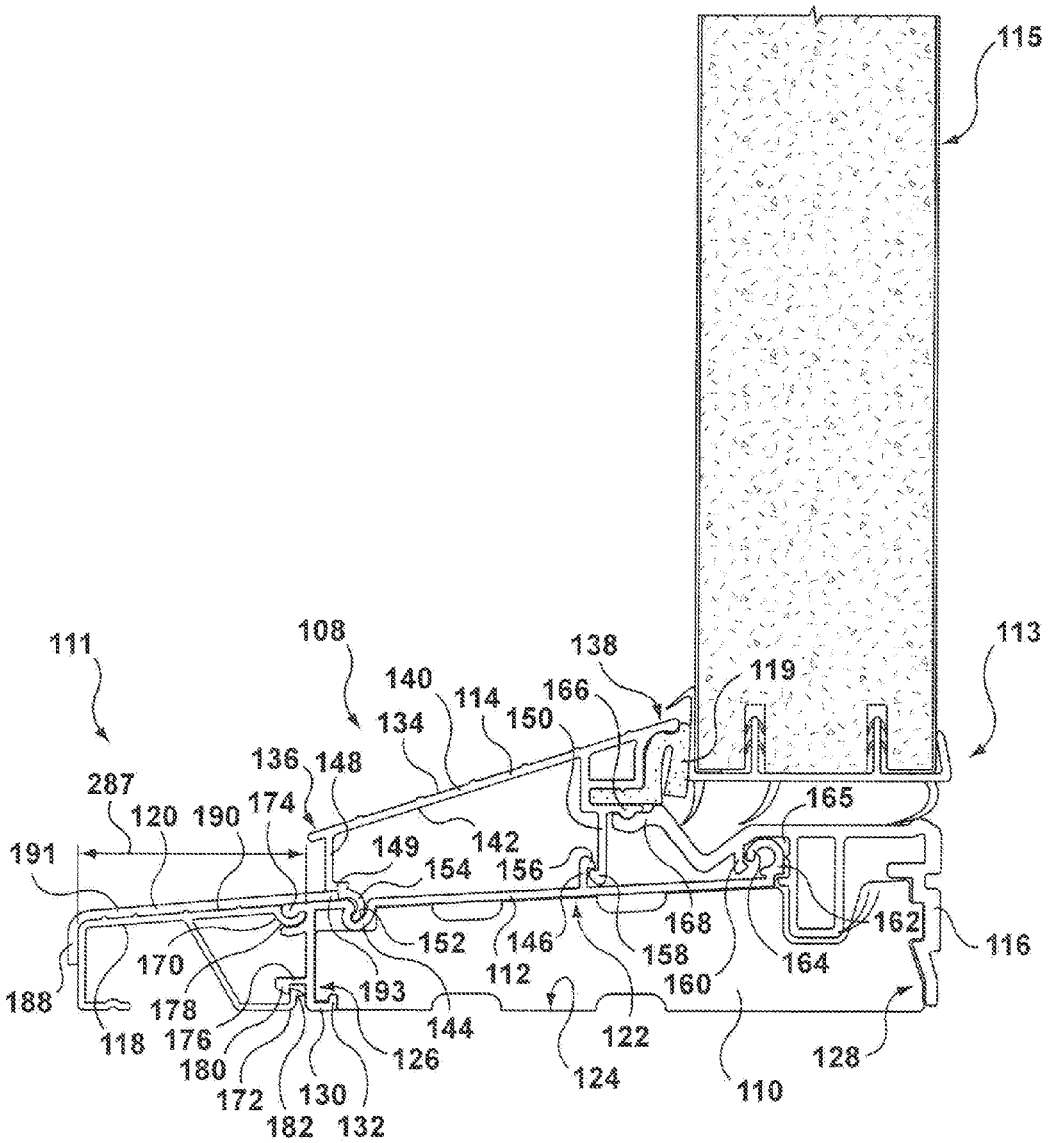
FIG. 2 is a cross-sectional view taken along line 2-2 in FIG. 1.

Referring to FIG. 2, the sill assembly 108 may be generally modular, and may be assembled from one or more extruded lineals. In the particular example shown in FIG. 2, the sill assembly 108 includes a sub sill 110, which may be a wooden board, as well as a base sill 112, a step sill 114, a door sweep 116, a nosing 118, and a cover plate 120, each of which is a separately formed extruded lineal. The sub sill 110, base sill 112, step sill 114, door sweep 116, nosing 118, and a cover plate 120 each extend along the sill axis 109 (shown in FIG. 1). Weatherstripping 119 may be installed in the sill assembly 108.

Figure 10:
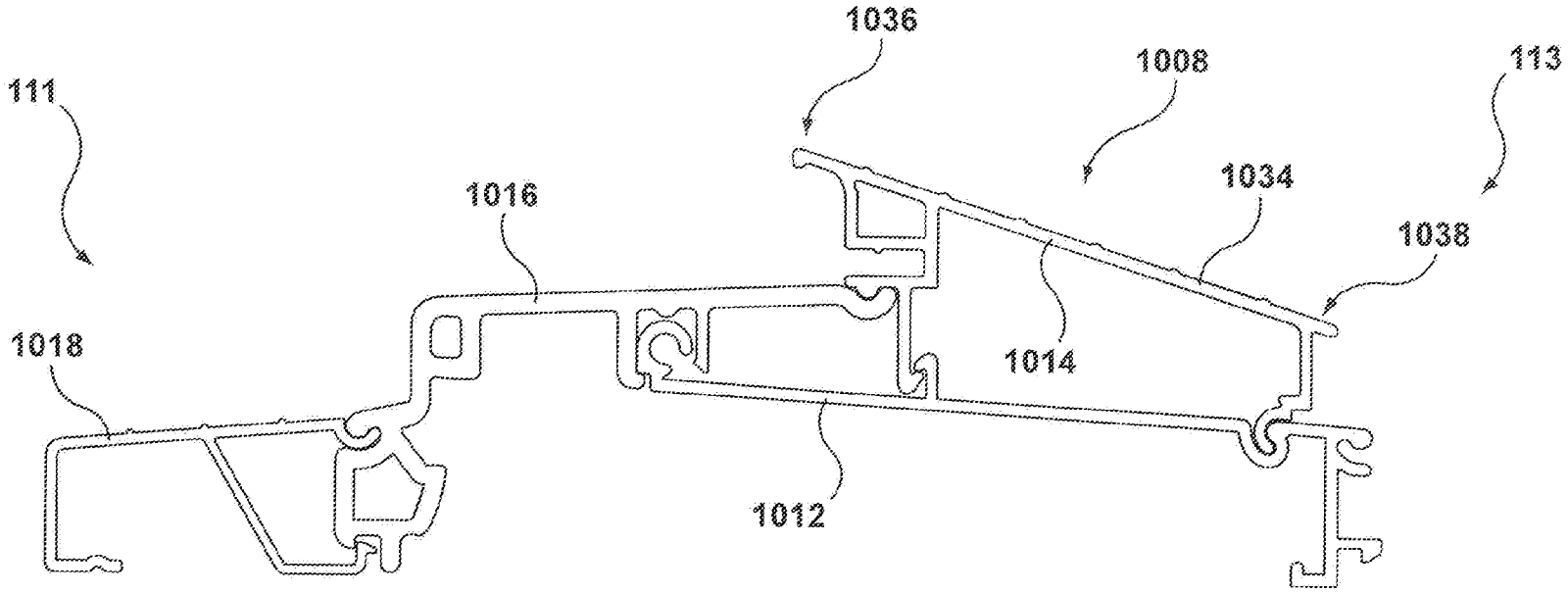
FIG. 10 is a cross-sectional view similar to the view shown in FIG. 2, showing an alternate sill assembly.

In the example shown in FIGS. 1 and 2, the sill assembly 108 is configured to support a door 115 that opens inwardly. In alternate examples, the sill assembly may be configured to support a door that opens outwardly, for example, as shown in FIG. 10 and described below.

Referring still to FIG. 2, in the example shown, the sub sill 110 includes an upper portion 122 (also referred to as a sub sill upper portion 122), and a lower portion 124 (also referred to as a sub sill lower portion 124), each of which extends between an exterior side 126 of the sub sill, and an interior side 128 of the sub sill 110.

Referring still to FIG. 2, the base sill 112 may be mounted to the sub sill 110 and may clad at least a portion of the sub sill upper portion 122. In the example shown, the base sill 112 clads a portion of the sub sill upper portion 122 that extends from the exterior side 126 to a position located before the interior side 128. Further, the base sill 112 clads the exterior side 126. In alternate examples, the base sill 112 may clad another portion of the upper portion 122, such as the entirety of the upper portion 122.

The base sill 112 may be removably mounted to the sub sill 110. In the example shown, the base sill 112 includes a clip member 130 (also referred to as a fourth base sill clip member) that engages the sub sill 110 to removably mount the base sill 112 to the sub sill 110. The clip member 130 includes a projection 132 that is receivable in notch of the sub sill 110.

Referring still to FIG. 2, the step sill 114 is removably mounted to the base sill 112, and includes an axially extending step sill upper surface 134 positioned above the base sill 112. In the example shown, the step sill upper surface 134 is generally planar, and extends at an acute angle with respect to the horizontal, so that an exterior end 136 of the upper surface 134 is lower than an interior end 138 of the upper surface 134.

In the example shown, the step sill 114 comprises a generally planar step sill wall 140 that is spaced from the base sill 112. The step sill wall 140 defines the upper surface 134, as well as an opposed lower surface 142.

In some examples, the base sill 112 may include at least one base sill clip member, and the step sill 114 may include at least one step sill clip member removably engaged with the base sill clip member to removably mount the step sill 114 to the base sill 112. Referring still to FIG. 2, in the example shown, the base sill 112 includes a first base sill clip member 144 and a second base sill clip member 146. Further, the step sill 114 includes a first step sill clip member 148 removably engaged with the first base sill clip member 144, and a second step sill clip member 150 removably engaged with the second base sill clip member 146.

In the example shown, the first base sill clip member 144 includes a recess 152, and the first step sill clip member 148 includes a projection 154 that is removably receivable in the recess 152. Further, the second base sill clip member 146 and second step sill clip member 150 each include a tab 156, 158, respectively. The tabs 156, 158 releasably interlock with each other.

In the example shown, the first step sill clip member 148 and second step sill clip member 150 extend downwardly from the step sill lower surface 142.

In use, the step sill 114 may be removable from the base sill 112. This may allow replacement of the step sill 114, for example, if damaged.

Referring still to FIG. 2, the door sweep 116 may be positioned interior to the step sill 114, and may be engaged with the step sill 114, the base sill 112, and/or the sub sill 110. In the example shown, the door sweep 116 comprises a first door sweep clip member 160, the base sill 112 comprises a third base sill clip member 162, and the first door sweep clip member 160 is removably engaged with the third base sill clip member 162. The third base sill clip member 162 includes a projection 164, and the first door sweep clip member 160 defines a pocket 165 in which the projection 164 is removably received.

In the example shown, the door sweep 116 is also engaged with the step sill 114. Specifically, the second step sill clip member 150 defines a shoulder 166, and the door sweep comprises an arm 168. The arm 168 is positioned beneath the shoulder 166 and abuts the shoulder 166. For example, there may be a nib and a recess that provide interlocking engagement between the shoulder 166 and arm 168.

In the example shown, the door sweep 116 is also engaged with the sub sill 110, and clads the portion of the sub sill 110 that is not cladded by the base sill 112. For example, as shown, the door sweep 116 may include a clip member for engaging a protrusion on the interior side 128 of the sub sill 110.

Referring still to FIG. 2, the nosing 118 may be positioned exterior to the base sill 112 and step sill 114, and in the example shown, is removably mounted to the base sill 112. Specifically, in the example shown, the nosing 118 includes a first nosing clip member 170 and a second nosing clip member 172, and the exterior side 126 of the base sill 112 includes a fifth base sill clip member 174 and a sixth base sill clip member 176. The first nosing clip member 170 is removably engaged with the fifth base sill clip member 174, and the second nosing clip member 172 is removably engaged with the sixth base sill clip member 176. In the example shown, the fifth base sill clip member 174 includes a recess, and the first nosing clip member 170 includes a projection 178 removably received in the recess. Further, the sixth base sill clip member 176 and the second nosing clip member 172 each include a tab 180, 182, respectively. The tabs 180, 182 releasably interlock with each other.

Referring now to FIGS. 3 to 7, alternate examples of a sill assembly are shown, which include alternate examples of a nosing. In FIGS. 3 to 7, similar features to FIG. 2 are identified by like reference numerals, incremented by a factor of 100 so that the first digit corresponds to the Figure number.

Figure 3:
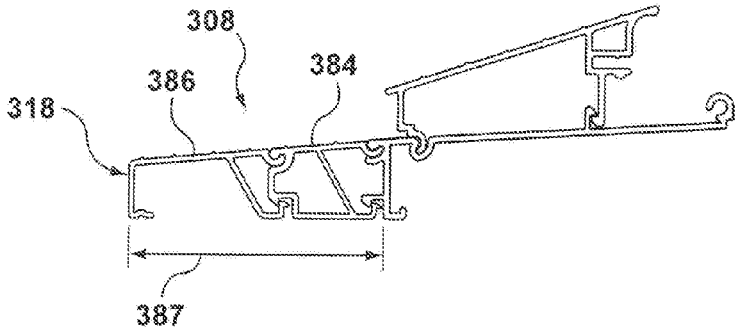
FIG. 3 is a cross-sectional view similar to the view shown in FIG. 2, showing an alternate sill assembly.

Referring to FIG. 3, in the sill assembly 308, the nosing 318 includes a first nosing piece 384 and a second nosing piece 386, which may be clipped together to form a nosing 318 that has a nosing depth 387 greater than the nosing depth 287 of FIG. 2. The sill assembly 308 may be used in a door frame having a greater depth than a door frame in which the sill assembly 208 is used.

Figure 4:
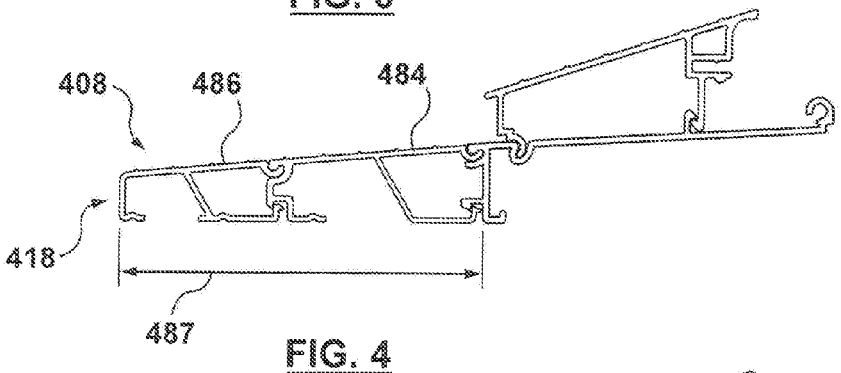
FIG. 4 is a cross-sectional view similar to the view shown in FIG. 2, showing an alternate sill assembly.

Referring to FIG. 4, in the sill assembly 408, the nosing 418 includes a first nosing piece 484 and a second nosing piece 486, which have a greater depth than the first 384 and second 386 nosing pieces, respectively, of FIG. 3. The first 484 and second 486 nosing pieces may be clipped together to form a nosing 418 that has a nosing depth 487 greater than the nosing depth 287 of FIG. 2 and the nosing depth 387 of FIG. 3. The sill assembly 408 may be used in a door frame having a greater depth than a door frame in which the sill assembly 208 is used, and greater depth than a door frame in which the sill assembly 308 is used.

Figure 5:
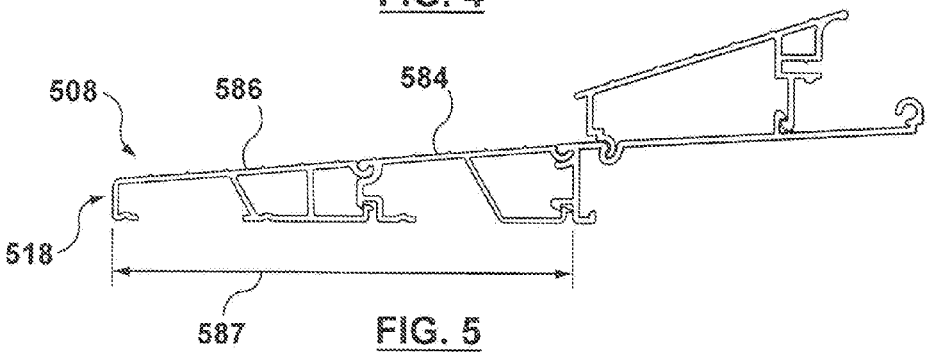
FIG. 5 is a cross-sectional view similar to the view shown in FIG. 2, showing an alternate sill assembly.

Referring to FIG. 5, in the sill assembly 508, the nosing 518 includes a first nosing piece 584, and a second nosing piece 586. The first nosing piece 584 is generally identical to the first nosing piece 484 of FIG. 4. The second nosing piece 586 has a greater depth than the second nosing piece 486 of FIG. 4. The first 584 and second 586 nosing pieces may be clipped together to form a nosing 518 that has a nosing depth 587 greater than the nosing depths 287, 387, 487 of FIGS. 2, 3, and 4, respectively. The sill assembly 508 may be used in a door frame having a greater depth than a door frame in which the sill assemblies 208, 308, and 408 are used.

Figure 6:
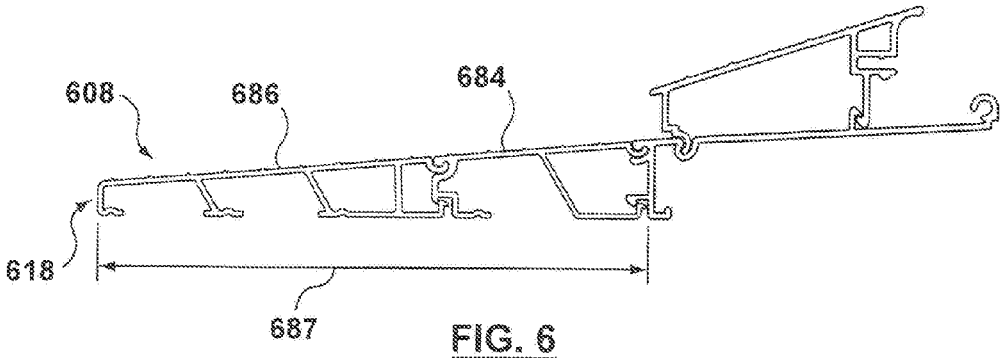
FIG. 6 is a cross-sectional view similar to the view shown in FIG. 2, showing an alternate sill assembly.

Referring to FIG. 6, in the sill assembly 608, the nosing 618 includes a first nosing piece 684, and a second nosing piece 686. The first nosing piece 684 is generally identical to the first nosing piece 484 of FIG. 4. The second nosing piece 686 has a greater depth than the second nosing piece 486 of FIG. 4, and the second nosing piece 586 of FIG. 5. The first 684 and second 686 nosing pieces may be clipped together to form a nosing 618 that has a nosing depth 687 greater than the nosing depths 287, 387, 487, 587 of FIGS. 2, 3, 4, and 5, respectively. The sill assembly 608 may be used in a door frame having a greater depth than a door frame in which the sill assemblies 208, 308, 408, and 508 are used.

Figure 7:
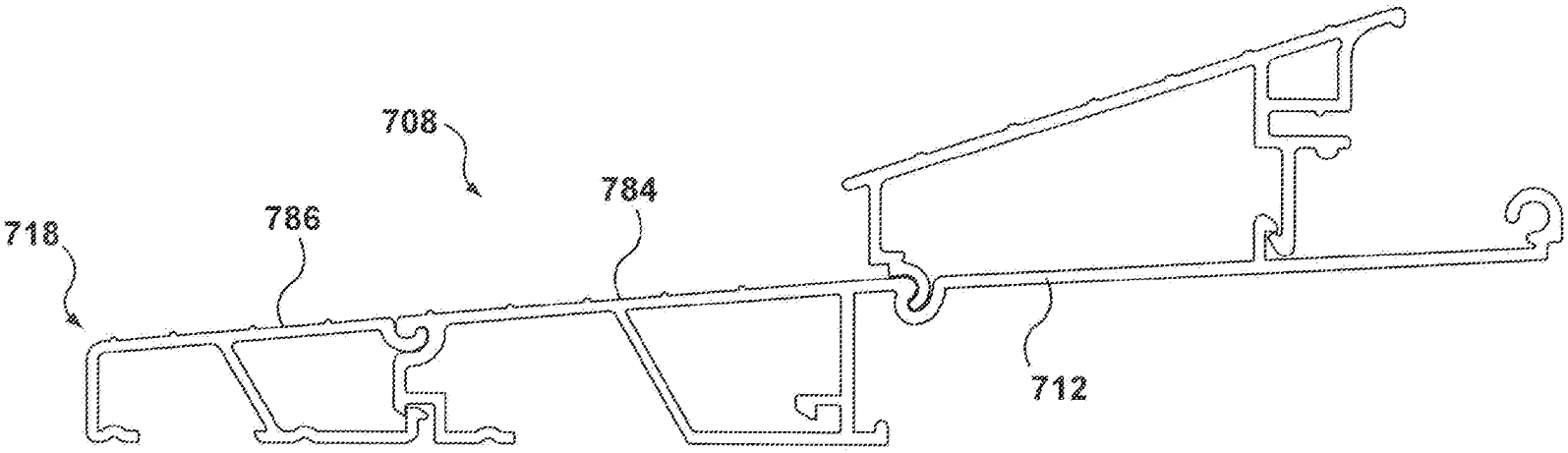
FIG. 7 is a cross-sectional view similar to the view shown in FIG. 2, showing an alternate sill assembly.

Referring to FIG. 7, in the sill assembly 708, the nosing 718 includes a first nosing piece 784 and a second nosing piece 786 which may be clipped together, and which are of the same general dimensions as the first 484 and second 486 nosing pieces of FIG. 4, respectively. The first nosing piece, however, is integrally formed with the base sill 712.

Referring back to FIG. 2, the cover plate 120 may cover and clad the nosing 118. In the example shown, the cover plate 120 includes a cover plate clip member 188 (also referred to as a "clip member 188") for removably mounting the cover plate to the nosing 118, and a generally planar cover plate cladding portion 191 (also referred to as a "cladding portion 191") for cladding at least a portion of the nosing 118. In the example shown, the cladding portion 191 clads an entire upper surface 190 of the nosing 118, as well as a portion of the base sill 112. Further, in the example shown, the first step sill clip member 148 includes a generally horizontally extending wall 149 spaced above the base sill 112. The wall 149 and the base sill 112 create a pocket in which a portion 193 of the cladding portion 191 is received.

Figure 8:
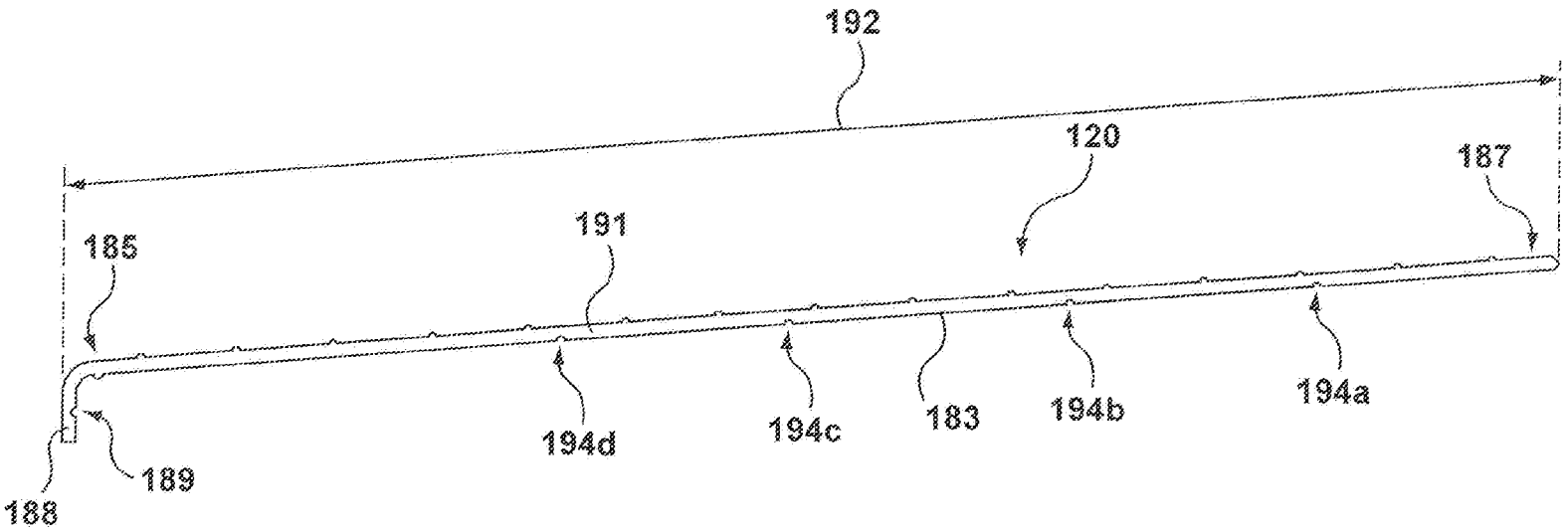
FIG. 8 is a side plan view of the example cover plate of FIG. 2, shown prior to adjusting the depth of a cladding portion thereof.

Referring now to FIG. 8, the cover plate 120 may be adjustable in size, so that it may be mounted to and fit any of the nosings in FIGS. 2 to 7. In the example shown, the cladding portion 191 has a first end 185, a second end 187, and a cladding portion depth 192 extending therebetween perpendicular to the longitudinal axis 109 (shown in FIG. 1). The cladding portion 191 may further include at least one marker. In the example show, the cladding portion includes a plurality of markers 194*a*, 194*b*, 194*c* and 194*d*, each of which includes a score line extending along the lower surface 183 of the cladding portion 191 transversely to the cladding portion depth 192. The cladding portion 191 is severable at the markers 194 to remove the second end 187 from the first end 185, and adjust the cladding portion depth 192 to fit any of the nosings 118-718. Specifically, in the example shown, the cladding portion 191 may be broken or cut along the score lines to adjust the cladding portion depth 192.

In the example shown, the cladding portion 191 may be severed at marker 194*a* to fit the nosing 518 of FIG. 5, or may be severed at marker 194*b* to fit the nosing 418 of FIG. 4, or may be severed at marker 194*c* to fit the nosing 318 of FIG. 3, or may be severed at marker 194*d* to fit the nosing 218 of FIG. 2. The cover plate 120 may be used as is, without severing the second end 187 of the cladding portion 191 from the first end 185, to fit the nosing 618 of FIG. 6.

Referring to FIGS. 2 and 8, in the example shown, the cover plate clip member 188 extends downwardly from the first end 185 of the cladding portion 191, and frictionally engages the nosing 118.

Figure 9:
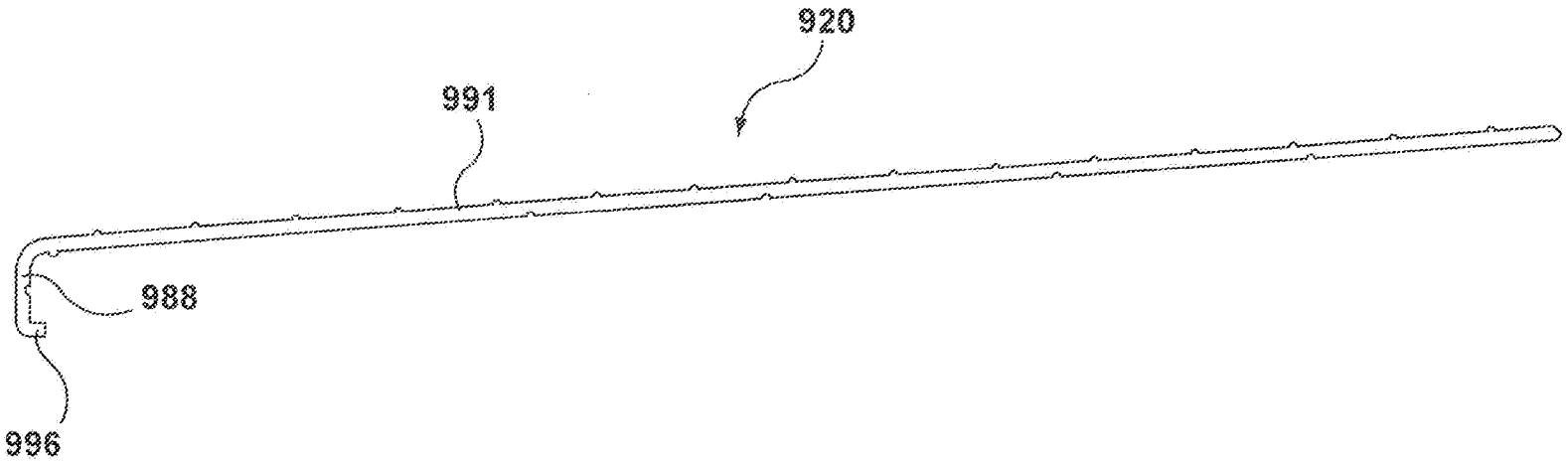
FIG. 9 is a side plan view of another example cover plate.

An alternate example of a cover plate 920 is shown in FIG. 9, in which similar features to FIG. 8 are identified with like reference numerals incremented by 800. In the cover plate 920, the cover plate clip member 988 is generally L-shaped, and includes a projection 996 that may be received in a recess of the nosing (not shown).

Referring back to FIG. 8, in the example shown, the cover plate clip member 188 includes a clip member marker 189 which includes a score line. The cover plate clip member 188 maybe severable at the clip member marker 189 to adjust the size of the cover plate clip member 188. For example, before installation of the cover plate 120, and after installation of the remainder of the sill assembly 108, concrete may be poured around the door frame to a certain height. In some instances, the height of the concrete may be such that insufficient space is left for the cover plate clip member 188. In such instances, the size of the cover plate clip member 188 may be adjusted by severing the cover plate clip member 188 at the clip member marker 189, in order to accommodate the height of the concrete.

In use, the cover plate 120 may be removable from the nosing 118. For example, if the cover plate 120 becomes damaged, it may be removed from the nosing 118 of the sill assembly 108. A second cover plate 120 may be provided to replace the damaged one, and the depth 192 of the cladding portion 191 of the second cover plate 120 may be adjusted to fit the nosing 118. For example, the cladding portion 191 may be severed at one of the markers 194*a* to 194*b*. The second cover plate 120 may then be removably clipped to the nosing 118 such that the cladding portion 191 of the second cover plate 120 clads the nosing 118.

Referring now to FIG. 10, an alternate example of a sill assembly 1008 is shown, in which similar features to FIG. 2 are identified with like reference numerals, incremented by 900. The sill assembly 1008 is configured to support a door that opens outwardly. The base sill 1012 and step sill 1014 are generally identical to the base sill 112 and step sill 114 of FIG. 2, but are rotated 180 degrees about a generally vertical axis, so that the exterior end 1036 of the upper surface 1034 is higher than an interior end 1038 of the upper surface 1034. The door sweep 1016 is mounted to the base sill 1012 and step sill 1014, and is positioned on the exterior side of the base sill 1012 and step sill 1014. The nosing 1018 is mounted to the door sweep 1016.

As mentioned above, the base sill 112, step sill 114, door sweep 116, nosing 118, and cover plate 120, may each be an extruded lineal. In one particular example, the base sill 112, step sill 114, nosing 118, and cover plate 120 may each be an extruded aluminum lineal, and the door sweep 116 may be an extruded vinyl lineal.

While the above description provides examples of one or more processes or apparatuses, it will be appreciated that other processes or apparatuses may be within the scope of the accompanying claims.

The invention claimed is:

1. A sill assembly for a door frame, comprising:

a) a sub sill extending along a generally horizontal sill axis, the sub sill comprising a sub sill upper portion;

b) a base sill extending along the sill axis, the base sill mounted to the sub sill and cladding at least a portion of the sub sill upper portion, the base sill comprising at least one base sill clip, member;

c) a step sill extending along the sill axis, the step sill comprising an axially extending step sill upper surface positioned above the base sill, and at least one step sill clip member removably engaged with the base sill clip member to removably mount the step sill to the base sill; and d) a nosing removably mounted to the base sill;

wherein each of the base sill, step sill, and nosing is a separately formed extruded lineal.

2. The sill assembly of claim 1, wherein the step sill comprises a step sill wall defining the step sill upper surface.

3. The sill assembly of claim 2, wherein the step sill wall is spaced from the base sill.

4. The sill assembly of claim 2, wherein the step sill wall defines an opposed step sill lower surface, and the at least one step sill clip member extends downwardly from the step sill lower surface.

5. The sill assembly of claim 1, wherein the at least one step sill clip member comprises a first step sill clip member and a second step sill clip member.

6. The sill assembly of claim 5, wherein the at least one base sill clip member comprises a first base sill clip member removably engaged with the first step sill clip member, and a second base sill clip member removably engaged with the second step sill clip member.

7. The sill assembly of claim 1, further comprising a door sweep separately formed from the step sill, base sill, and sub sill, wherein the door sweep comprises a first door sweep clip member, the base sill comprises a third base sill clip member, and the first door sweep clip member is removably engaged with the third base sill clip member.

8. The sill assembly of claim 1, wherein the nosing is positioned exterior to the base sill and step sill.

* * * * *